US005353675A

United States Patent [19]

Kimura et al.

[11] Patent Number: 5,353,675

[45] Date of Patent: Oct. 11, 1994

[54] OPEN-CLOSE STRUCTURE FOR A KEYED INSTRUMENT

[75] Inventors: Masaji Kimura; Yoshiaki Shimoda, both of Hamamatsu, Japan

[73] Assignee: Kabushiki Kaisha Kawai Gakki Seisakusho, Shizuoka, Japan

[21] Appl. No.: 42,774

[22] Filed: Apr. 6, 1993

[30] Foreign Application Priority Data

Apr. 7, 1992 [JP] Japan ..... 4-29361[U]

[51] Int. Cl.[5] ..... G10C 3/12; G10C 3/02

[52] U.S. Cl. ..... 84/423 R; 84/179

[58] Field of Search ..... 84/423 R, 178, 179

[56] References Cited

U.S. PATENT DOCUMENTS 788,044 4/1905 Haddorff ..... 84/179

5,076,129 12/1991 Wakuda ..... 84/179

*Primary Examiner*—Michael L. Gellner

*Assistant Examiner*—Cassandra C. Spyrou

*Attorney, Agent, or Firm*—Wegner, Cantor, Mueller & Player

[57] ABSTRACT

An open-close structure of a slide lid of a keyed instrument which guides the sliding motion of the slide lid includes a pair of inside plates each being arranged at each side of a keyboard and extending into the main body of the keyed instrument. The invention includes a slide lid that is adapted to be guided through an engagement of a pair of pinion-shaped members arranged at each side of the slide lid with a pair of rack-shaped members arranged on the inside plates. Each of the inside plates has a guide path arranged near and extending along the rack-shaped member. The slide lid has a roller arranged near each pinion-shaped member which is adapted to roll on one of the guide paths and support the slide lid so that the pinion shaped members mesh with the rack-shaped members in a condition in which no weight is applied to the rack-shaped members through the pinion-shaped members.

4 Claims, 5 Drawing Sheets

OPEN-CLOSE STRUCTURE FOR A KEYED INSTRUMENT

BACKGROUND OF THE INVENTION

1. Field of the invention

The present invention relates to an open-close structure of a slide lid for a keyed instrument such as an electronic piano.

2. Description of Background Art

Heretofore it is known an open-close structure of a slide lid for a keyed instrument, for example, as disclosed in Japanese Laid-open Utility Model Publication No. 8390/1991. This slide lid is adapted to be slid between a closed position in which the lid is proximally drawn out of the main body of the musical instrument to cover the keyboard and an opened position in which the keyboard is exposed with the lid being pushed into the main body of the instrument. Inside plates of the arm members extended into the musical instrument are arranged at opposite sides of the keyboard. Each inside plates is provided, at its front exposed portion, with a decoration plate for supporting the slide lid in its closed position and for decorating the keyboard and, at its rear portion concealed in the musical instrument, with a rack as well as a guide groove for achieving smooth sliding motion of the lid. The rear end of the slide lid is provided with a pair of pinions which are arranged above said racks to mesh therewith and also provided with a supporting shaft for supporting the pinions of which opposite ends are adapted to be guided within said guide groove. That is, the supporting shaft is rotatably supported via a pair of holders at the rear end of the slide lid and each pinion is secured to the end of the supporting shaft with leaving a portion of the shaft which is received within the guide groove. Accordingly the slide lid can be slid uniformly in its right and left portions thereof due to its vertical motion guided by the guide grooves in the inside plates and due to the pinions rolling on the racks.

In the slide lid of the prior art, the oblique motion of the slide lid is prevented by the combination of said racks and pinions. However, since the weight of the slide lid is applied to the meshing portions of the racks and pinions during the opening and closing operation, the tooth tips of one of the rack or the pinion interfere with the tooth grooves of the other and clog each other, which causes a heavy load for opening and closing the lid as well as uncomfortable touch feeling generating rumble or noise. In addition, the use for a long period of time causes wear of the racks and pinions and looseness therebetween.

SUMMARY OF THE INVENTION

It is therefore an object of the present invention to provide an open-close structure of a slide lid for a keyed instrument which enables smooth opening and closing of the slide lid.

For achieving the above object, there is provided according to a first present invention an open-close structure of a slide lid for a keyed instrument for guiding the sliding motion of the slide lid comprising a pair of inner plates or inside plates of the arm members each being arranged at each side of a keyboard and extending therefrom into the main body of the keyed instrument, and a slide lid slidable between a closed position in which the slide lid covers the keyboard and an opened position in which the slide lid is retracted into the main body of the keyed instrument wherein the sliding motion of the slide lid is adapted to be guided through an engagement of a pair of pinion-shaped members each arranged at each side of the slide lid and rack-shaped members each arranged in the inside plates characterized in that each of the inside plates has a guide path arranged near the rack-shaped member and extending along the rack-shaped member, the slide lid has roller means arranged near each pinion-shaped member and being adapted to roll on the guide path, and the roller means supports the slide lid so that the pinion-shaped members mesh with the rack-shaped members in a condition in which the pinion-shaped members are slightly floated from the rack-shaped Embers.

According to the open-close structure of a slide lid for a keyed instrument, the slide lid is guided without the oblique motion thereof due to the mesh of the pinion-shaped Embers with the rack-shaped member of the inside plates when the slide lid is moved between the closed position and the opened position. During this sliding motion of the lid, the roller means rolls on the guide path arranged near the rack-shaped member. In this case, since the pinion-shaped member meshes with the rack-shaped member with being slightly floated from the rack-shaped member, all the weight of the lid is supported by the roller means and thus no weight is applied to the rack-shaped members through the pinion-shaped members.

DESCRIPTION OF THE PREFERRED EMBODIMENT

Preferred embodiments of an electronic piano to which the present invention is applied will be hereinafter described with reference to the accompanying drawings.

Figure 1:
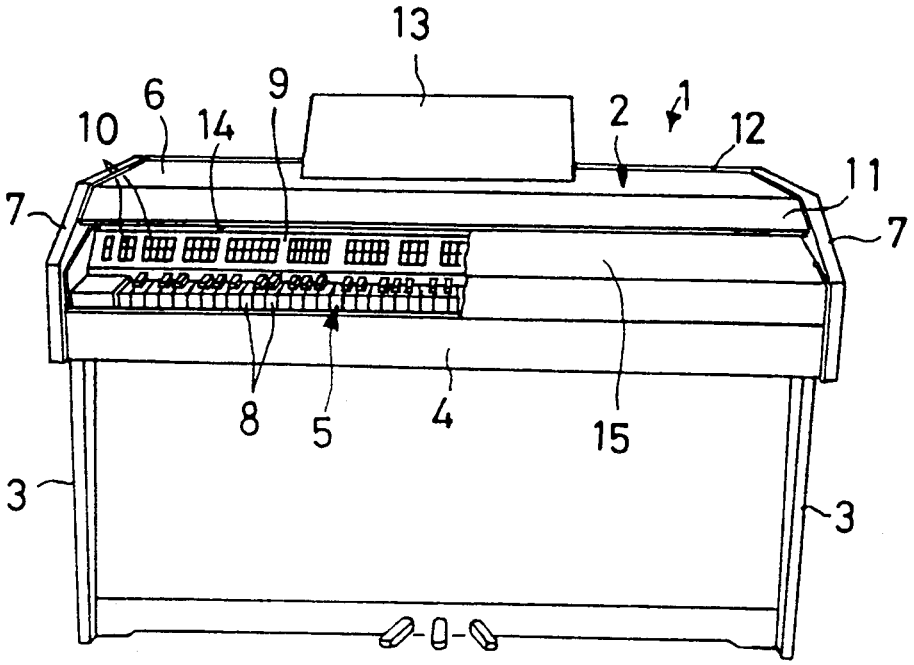
FIG. 1 is an exterior view of an electronic piano according to the present invention.

FIG. 1 is an exterior view of an electronic piano 1 which comprises a main body 2 and two leg portions 3 and 3 of a piano. The main body 2 has a keyboard section 5 and a device section 6 arranged before and behind on the bottom plate 4 attached to the leg portions 3 and 3 ("before" and "behind" used herein mean respectively "proximal" to and "distal" from a player) and also has a pair of arm members 7 and 7 arranged with sandwiching the keyboard section 5 and the device section 6 therebetween.

The keyboard section 5 has a keyboard 8 and a control panel 9 covering the rear portion of the keyboard 8 in which many kinds of control switches 10 are arranged. The device section 6 has a top plate 11 and a rear plate 12 and contains an acoustic device and the like in a space defined between these plates 11 and 12 and the bottom plate 4. A music stand 13 is mounted on the top of the top plate 11. Formed between the upper surface and the front end of the top plate 11 is a slit 14 through which a slide lid 15 can slide in and out from the inside of the device section 6. The slide lid 15 can slide before and behind directions along the two arm members 7 and 7 and can open and close the upper space of the keyboard section 5 to cover and protect the keyboard 8.

Figure 2:
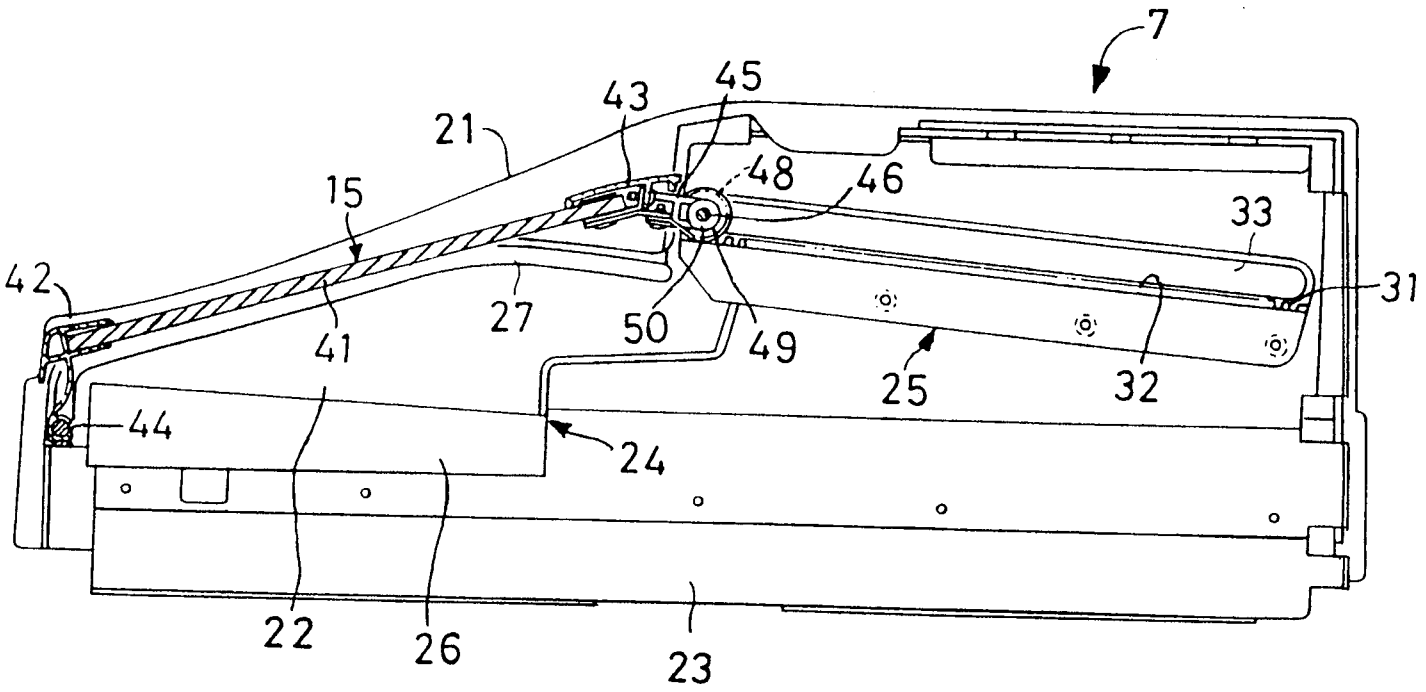
FIG. 2 is a sectional side-elevation view of the electronic piano of FIG. 1 showing the mount of a slide lid to an arm member.
Figure 3:
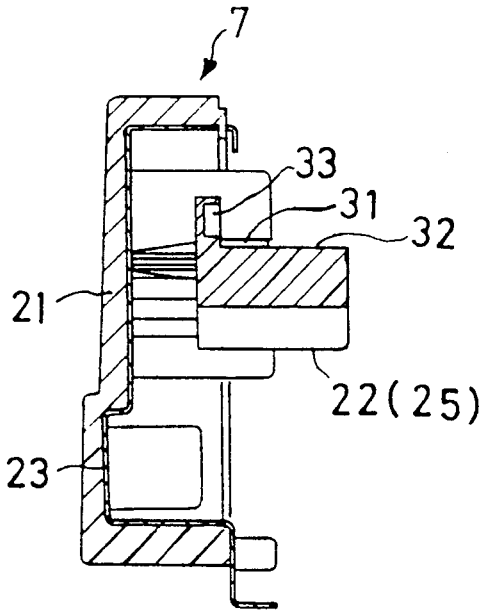
FIG. 3 is a vertical cross-sectional view of an arm member of the electronic piano of FIG. 1.
Figure 4:
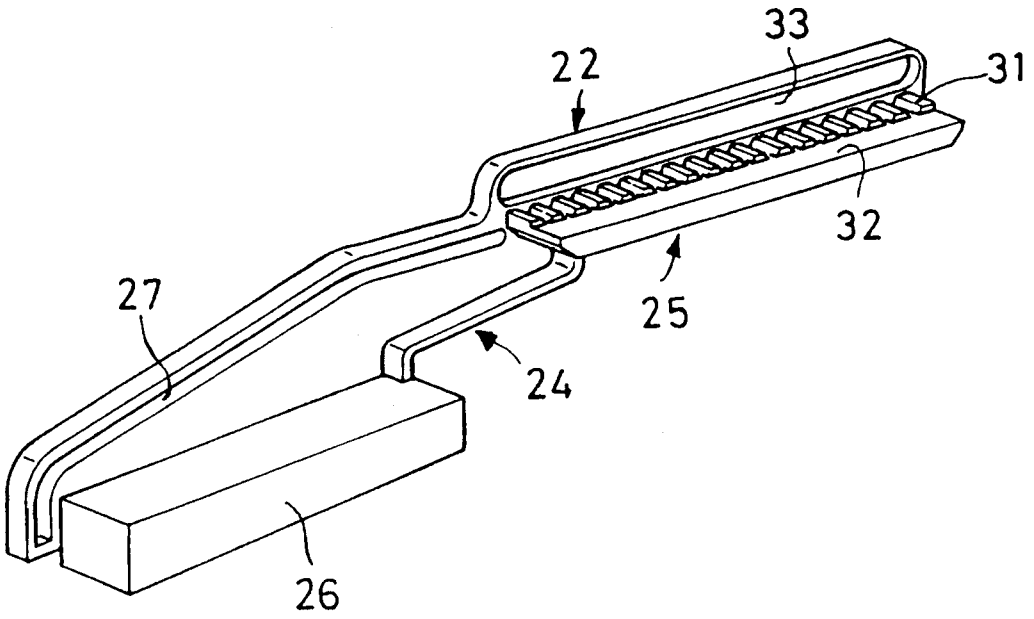
FIG. 4 is a perspective view of an inner plate of an arm member of the electronic piano of FIG. 1.

Then the arm members 7 and the slide lid 15 will be described with reference to FIGS. 2 through 4. FIG. 2 is a side-elevation view showing the mount of the slide lid 15 to the arm member 7, FIG. 3 is a vertical cross-sectional view of the arm member 7, and FIG. 4 is a perspective view of an inside plate. As shown in FIG. 3, each arm member 7 comprises an outer plate 21, an inner plate (i.e. an inside plate) 22 and a reinforcing plate 23 to which the outer and inner plates 21 and 22 are mounted.

As shown in FIGS. 2 and 4, each inner plate 22 of the arm member 7 comprises a decorative portion 24 of its front half and a lid guide portion 25 of its rear half and is secured to the reinforcing plate 23 of the arm member. The decorative portion 24 is exposed to the outside of the device section 6 and the lid guide portion 25 is concealed in the inside of the device section 6. In the decorative portion 24, a clapper 26 is arranged with projected from the lower part thereof along the keyboard 8 and a front guide groove 27 is formed as a recess at the upper part of the decorative portion 24. The front guide groove 27 extends from the front end to the rear end of the decorative portion 24 along the periphery thereof and slidably guides the front end of the slide lid 15.

In the lid guide portion 25, a rack 31 and a guide path 32 are arranged at a lower half thereof and a rear guide groove 33 is formed as a recess at an upper half thereof. The rack 31 and the guide path 32 are arranged side by side on the upper surface of the lid guide portion 25 so that the rack 31 is on the side of the arm member 7 and the guide path 32 is on the side of the slide lid 5. That is, the rack 31 is positioned at one side of the guide path 32 near the arm member 7. The rack 31, the guide path 32 and the rear guide groove 33 all extend straight from the front end to the rear end of the lid guide portion 25 and slidably guide the rear end of the slide lid 15.

Figure 5:
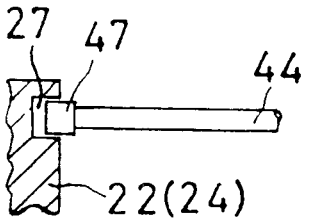
FIG. 5 is a sectional front elevation view of a front guide groove of an inner plate of an arm member of the electronic piano of FIG. 1.

As shown in FIG. 2, the slide lid 15 comprises a lid body 41, and a front frame plate 42 and a rear frame plate 43 respectively mounted on the front and rear ends of the lid body 41. A front guide bar 44 is mounted on the front end of the front frame plate 42 and a rear guide bar 46 is rotatably mounted on the rear end of the rear frame plate 43 via a pair of holders 45 and 45. As shown in FIG. 5, the outer end of the front guide bar 44 is slightly projected from the front frame plate 42 and a roller cap 47 is mounted on the projected end of the bar 44 so that it can slidably engage with the front guide groove 27 of the inner plate 22 of the arm member 7 and can guide the front portion of the slide lid 15 (only one end of the bar 44 is shown in FIG. 5).

Figure 6:
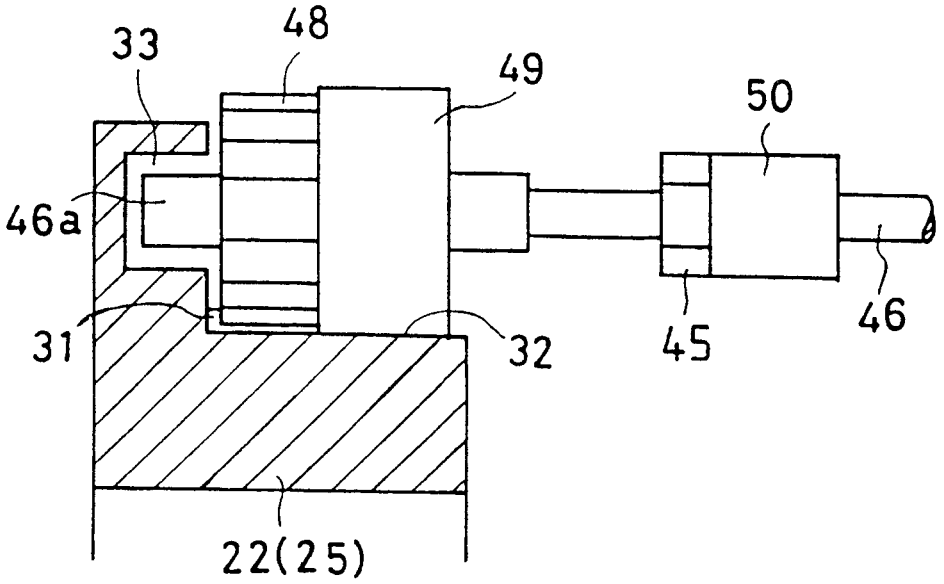
FIG. 6 is a sectional front elevation view of a rack and a pinion of the electronic piano of FIG. 1.

As shown in FIG. 6, the outer end of the rear guide bar 46 is also slightly projected from the slide lid 15. The tip end of the projected portion **46*a* on which a cap is mounted is adapted to engage the rear guide groove 33 of the inner plate 22 of the arm member 7. The rear guide bar 46 can be thus slidably engaged with the rear guide groove 33 to slidably guide the rear portion of the slide lid 15. A pinion 48 meshing with the rack 31 is secured to each end of the rear guide bar 46 inside the projected portion 46*a* and a roller 49 rolling on the guide path 32 is also secured to the each end of the rear guide bar 46 adjacent to the pinion 48 (only one end of the bar 46 is shown in FIG. 6). The diameter of the roller 49 is slightly larger than that of the pinion 48 so that the rollers 49 support the weight of the slide lid 15 with the pinions 48 being meshed with the racks 31 in a condition in which the pinions 48 are slightly floated from the racks 31. A reference numeral 50 in FIG. 6 denotes a stopper for limitting the axial displacement of the rear guide bar 46**.

The slide lid 15 having a structure mentioned above can be slid with being guided by the front guide grooves 27 and the rear guide grooves 33 between the closed position in which the slide lid 15 covers the keyboard 8 and the opened position in which the slide lid 15 is retracted into the device section 6. In this case, since the pinions 48 arranged at left and right sides of the slide lid 15 mesh with racks 31 of the left and right inner plates 22, the oblique motion of the slide lid 15 during the sliding displacement can be effectively prevented. During this time, since the rollers 49 arranged at left and right sides of the slide lid 15 roll on the guide paths 32 of the left and right inner plates 22, the pinions 48 mesh with the racks 31 with being slightly floated from the racks 48 and thus the clogging of the racks 31 and the pinions 48 is effectively prevented. Accordingly the uncomfortable touch feeling and generation of rumble or noise during the opening and closing of the slide lid 15 can be prevented as well as the wear of the racks and pinions can be also reduced.

Alternately, instead of the .guide paths 32 and the rollers 49 such as shown in the embodiment of FIG. 6, it is possible to use the bottom surfaces of the rear guide grooves 33 as guide paths as well as to mount rollers engaging with the bottom surfaces of the rear guide grooves 33 on the the projected portions **46*a* of the rear guide bar 46. In this case, since the rear guide grooves 33 can be used both as guide grooves for the rear guide bars 46** and as guide paths for the rollers, the structure can be simpified.

Figure 7:
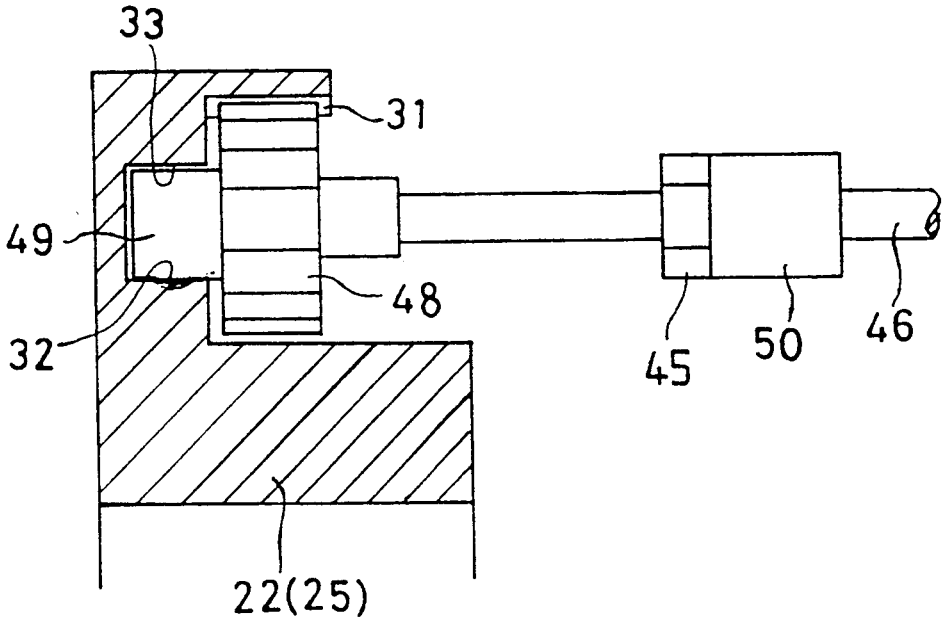
FIG. 7 is a sectional front elevation view of a rack and a pinion of a second embodiment of the present invention.

Then a second embodiment of the present invention will be described with reference to FIG. 7. FIG. 7 shows main parts of the second embodiment corresponding to those of FIG. 6. In this embodiment racks 31 are arranged above pinions 48 and the bottom surfaces of rear guide grooves 33 are used as guide paths 32 and in addition rollers 49 are rotatably mounted on the projected portions **46*a* of the rear guide bar 46. With this structure, the pinions 48 can be always kept in the floated condition from the racks 31 and thus the clogging of the racks 31 and the pinions 48** can be effectively prevented.

What is claimed is:

1. An open-close structure for a keyed instrument having a main body having a front and a pair of sides with a keyboard at the front of the main body, and an arm member at each of said pair of sides of the main body, said open-close structure comprising:

an inside plate adapted to be attached on each of said arm members, the inside plates being arranged at each of said sides of the keyboard and extending therefrom into the main body;

a slide lid having a pair of sides, said slide lid being slidable between a closed position in which the slide lid covers the keyboard and an opened position in which the slide lid is retracted into the main body;

a pinion-shaped member arranged at each of said pair of sides of the slide lid;

a rack-shaped member arranged at each of said pair of sides of the slide lid and attached to the inside plates;

a pair of guide paths, each of the guide paths being arranged near and extending along one of the rack-shaped members; and a pair of roller means, one of the roller means being arranged at each of said pair of sides of the slide lid and supporting the slide lid by engagement with the guide path so that the pinion-shaped members mesh with the rack-shaped members in a condition in which no weight is applied to the rack-shaped members through the pinion-shaped members.

2. An open-close structure for a keyed instrument as set forth in claim 1, wherein each of the rack-shaped members is arranged below one of the pinion-shaped members.

3. An open-close structure for a keyed instrument as set forth in claim 1, wherein each of the rack-shaped members is arranged above one of the pinion-shaped members.

4. An open-close structure for a keyed instrument as set forth in claim 1, wherein each of said pair of guide paths is arranged to contact one of said roller means twice.

* * * * *